US006817568B2

(12) United States Patent
Spate et al.

(10) Patent No.: US 6,817,568 B2
(45) Date of Patent: Nov. 16, 2004

(54) MISSILE SYSTEM WITH MULTIPLE SUBMUNITIONS

(75) Inventors: Wayne V. Spate, Cortaro, AZ (US); Arthur J. Schneider, Tucson, AZ (US); Michael B. McFarland, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/376,192

(22) Filed: Feb. 27, 2003

(65) Prior Publication Data

US 2004/0169107 A1 Sep. 2, 2004

(51) Int. Cl.[7] ..... F42B 12/56; F42B 10/60; F42B 10/00; F42B 15/01; F41G 7/00

(52) U.S. Cl. ..... 244/3.15; 244/3.1; 244/3.11; 244/3.14; 244/3.19; 244/3.21; 89/1.11

(58) Field of Search ..... 89/1.11; 102/382, 102/384, 393, 473, 489; 244/3.1–3.3

(56) References Cited

U.S. PATENT DOCUMENTS 3,741,501 A * 6/1973 Salkeild ..... 244/3.14
4,492,166 A * 1/1985 Purcell ..... 244/3.22
4,554,871 A * 11/1985 Nixon ..... 244/3.19
5,005,781 A 4/1991 Baysinger et al.
6,016,990 A 1/2000 Small
6,037,899 A * 3/2000 Weber ..... 244/3.2
6,364,248 B1 4/2002 Spate et al.
6,481,666 B2 * 11/2002 Frucht ..... 244/3.15
2003/0057320 A1 3/2003 Schneider et al.

OTHER PUBLICATIONS

"MIRV: A Brief History of Minuteman and Multiple Reentry Vehicles"; Lawrence Laboratory; Livermore, California; Report COVD–1571; Feb. 1976.*

* cited by examiner

*Primary Examiner*—Bernarr E. Gregory
(74) *Attorney, Agent, or Firm*—Renner, Otto, Boisselle & Sklar, LLP

(57) ABSTRACT

A multi-staged missile includes a booster and a submunition delivery vehicle that has one or more submunitions. The booster rapidly accelerates the submunition vehicle, and then separates from the submunition vehicle. The submunition delivery vehicle is then maneuvered to approach a target. Individual submunitions finally separate, and are individually guided to the target. By providing multiple, independently-targeted submunitions, the missile greatly increases the chances of hitting the target.

20 Claims, 4 Drawing Sheets

MISSILE SYSTEM WITH MULTIPLE SUBMUNITIONS

TECHNICAL FIELD

The invention is related to missile systems, and in particular to missile systems designed to destroy or neutralize highly-maneuverable, fast-moving targets.

BACKGROUND OF THE RELATED ART

In defense against anti-ship missiles, a layered defense system is employed, involving long- and intermediate-range missiles, and involving gun systems for use at short range, as a final element of defense to stop incoming missiles. However, as speeds of anti-ship missiles have increased, the effectiveness of gun systems has been reduced, since supersonic missiles may often fly a considerable distance, on the order of a kilometer or more, after having been struck by a gun projectile. Accordingly, it would be desirable to replace or supplement the current utilized gun systems.

SUMMARY OF THE INVENTION

According to an aspect of the invention, a missile for hitting a moving target includes a booster, and a submunition delivery vehicle separably coupled to the booster. The submunition delivery vehicle includes at least one submunition; and a beacon coupled to the at least one submunition. The beacon is configured to emit a signal indicating position of the submunition delivery vehicle.

According to another aspect of the invention, a missile for hitting a moving target includes a booster; and a submunition delivery vehicle separably coupled to the booster. The submunition delivery vehicle includes multiple independently-maneuverable submunitions; and a beacon coupled to the submunitions. The beacon is configured to emit a signal indicating position of the submunition delivery vehicle. The submunitions each include: an articulatable nose; a nose actuator operatively coupled to the nose to position the nose; controller electronics operatively coupled to the nose actuator to control steering of the submunition; a beacon configured to emit a signal indicating position of the submunition; a tail cavity capable of receiving a nose of another of the submunitions; and deployable fins. The submunitions are arrayed in line along an axis of the submunition delivery vehicle.

According to yet another aspect of the invention, a method of hitting a target with a missile includes: accelerating the missile using a booster of the missile; separating the booster from a submunition delivery vehicle of the missile, wherein the submunition delivery vehicle includes multiple independently-guidable submunitions; separating the submunitions from the submunition delivery vehicle; and independently guiding the submunitions to the target.

To the accomplishment of the foregoing and related ends, the invention comprises the features hereinafter fully described and particularly pointed out in the claims. The following description and the annexed drawings set forth in detail certain illustrative embodiments of the invention. These embodiments are is indicative, however, of but a few of the various ways in which-the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, which are not necessarily to scale.

DETAILED DESCRIPTION

A multi-staged missile includes a booster and a submunition delivery vehicle that has one or more submunitions. The booster rapidly accelerates the submunition delivery vehicle, and then separates from the submunition delivery vehicle. The submunition delivery vehicle is then maneuvered to approach a target. Individual submunitions finally separate, and are individually guided to the target. By providing multiple, independently-targeted submunitions, the missile greatly increases the chances of hitting the target.

Figure 1:
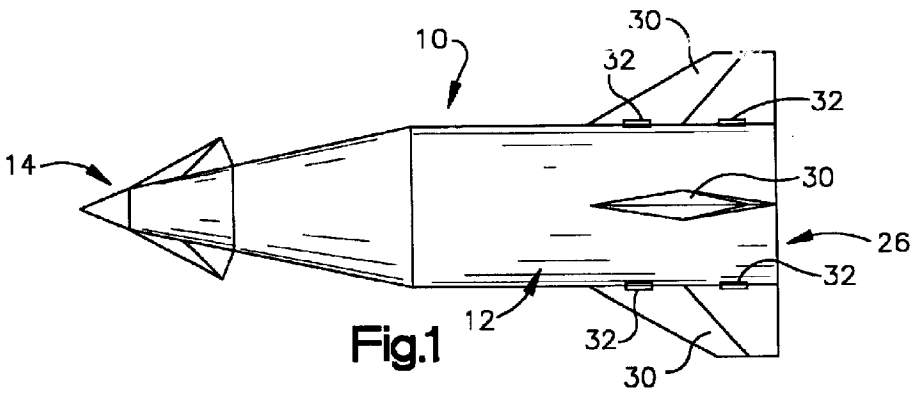
FIG. 1 is a side view of a missile according to the present invention.
Figure 2:
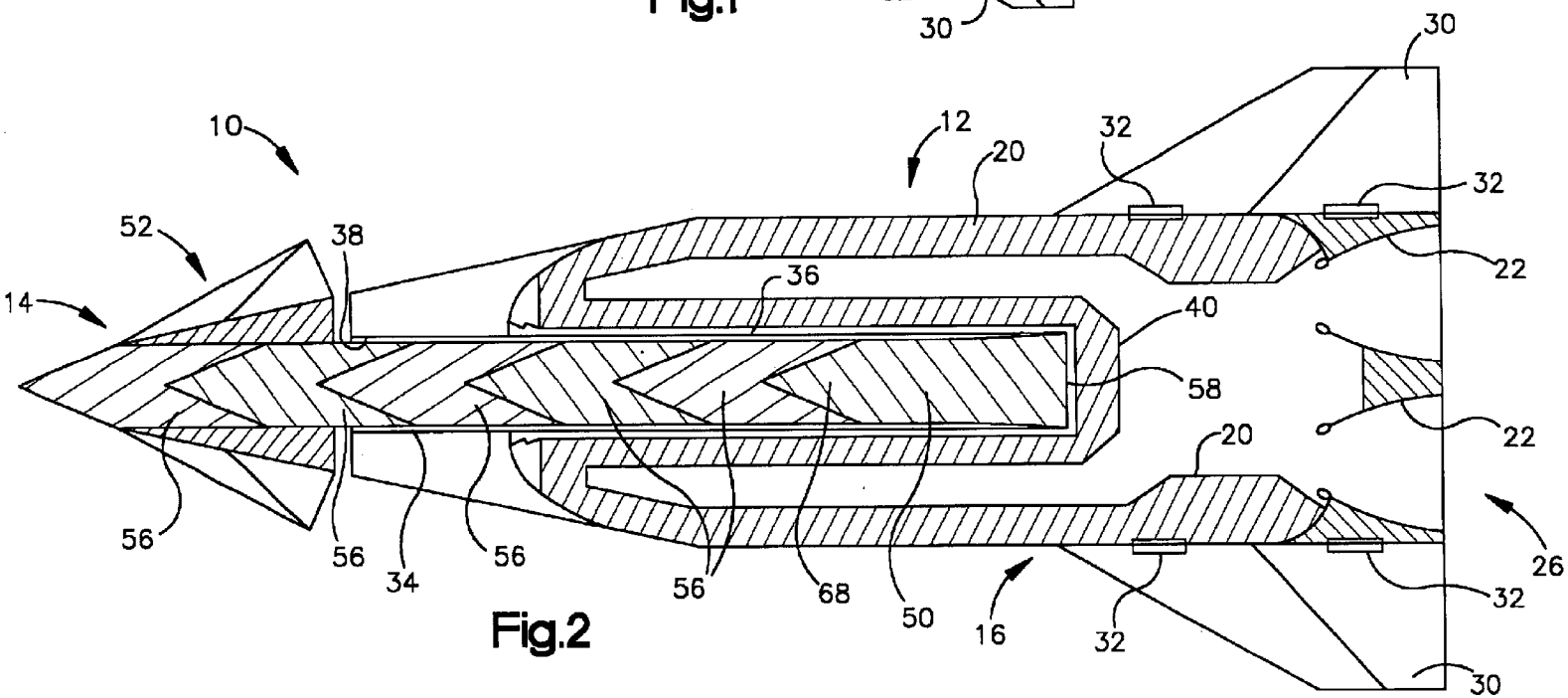
FIG. 2 is a cross-sectional view of the missile of FIG. 1, showing interior parts of the missile.

Referring initially to FIGS. 1 and 2, a missile 10 includes a booster 12 which is coupled to a submunition delivery vehicle 14. The booster 12 provides thrust to quickly accelerate the submunition delivery vehicle 14. Thus the booster 12 includes a rocket motor 16, which includes a solid propellant 20 and nozzles 22. Combustion of the solid propellant 20 produces gases that exit the booster 12 through the nozzles 22, thereby providing thrust to accelerate the missile 10.

The booster 12 may include a thrust vector control system 26 for maneuvering the missile 10. The thrust vector control system 26 may include jet vanes or diverters placed in or along plumes emerging from the nozzles 22. Alternatively, the thrust vector control system 26 may include devices for reconfiguring the nozzles 22, such as by tilting and/or deforming the nozzles 22, to thereby redirect the direction of the thrust on the missile 10.

The booster 12 also includes fins 30 for providing stability and/or maneuverability. The fins 30 may be fixed fins. Alternatively, the fins 30 may be moveable, so as to aid in controlling the missile 10. As another alternative, the fins 30 may be curved and held to the body of the missile 10 by hinges 32, such as shown FIGS. 1 and 2, to allow the fins 30 to be folded flat to the outer surface of the missile 10. The fins 30 may conform to the body of the missile 10 when the missile 10 is launched. The fins 30 may be configured to be deployed outward when the missile 10 is launched. The fins 30 may be deployed centrifugally, by spinning the missile 10 Alternatively, other suitable means may be used to deploy the fins 30. The hinges 32 may include locks to maintain the fins 30 in their deployed positions. The locks may include any of a variety of suitable mechanical elements. If desired, the fins 30 may be canted relative to an axis of the missile 10, so as to induce spinning in the missile 10. Although shown in FIGS. 1 and 2 as straight, it will be appreciated that the fins 30 may be canted, if desired, for example, to create roll in the missile 10.

The booster 12 includes a cavity 34 for receiving the submunition delivery vehicle 14 therein. The cavity may be formed by a shell 36 that has an open outer end 38 and a closed inner end 40. Such a cavity in a booster is described in U.S. Pat. No. 5,005,781, which is incorporated herein by reference in its entirety.

The thrust vector control system 26 may include control electronics for controlling adjustments to the thrust vectoring and/or controlling moveable fins. The booster 12 may include an antenna, transponder, or beacon for providing location information, and/or receiving course correction and/or target location information.

Figure 3:
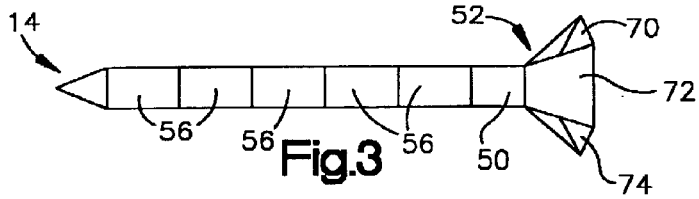
FIG. 3 is a side view showing the submunition delivery vehicle of the missile of FIG. 1.

The submunition delivery vehicle 14 includes a tail section 50, an aerodynamic control section 52, and multiple submunitions 56. The submunitions 56 may be arrayed in line along an axis of the submunition delivery vehicle 14. As explained in greater detail below, the aerodynamic controls section 52 is configured such that, after the submunition delivery vehicle 14 separates from the booster 12, the control section 52 slides back along the submunitions 56 to engage in an enlarged end 58 of the tail section 50, as shown in FIG. 3, thereby becoming part of the tail section 50. This sliding is similar to that disclosed in the above-mentioned patent, U.S. Pat. No. 5,005,781.

Figure 4:
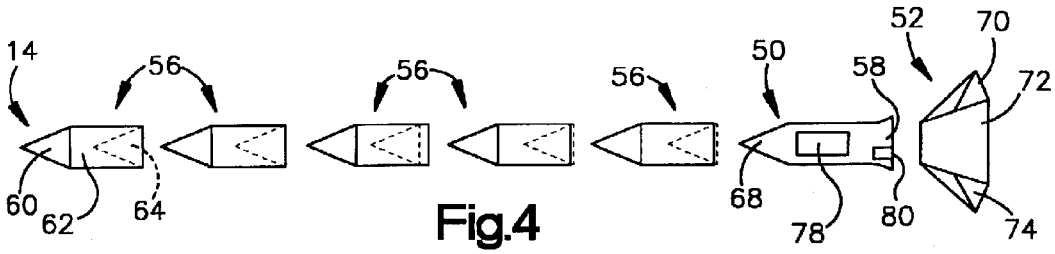
FIG. 4 is an exploded view of the submunition delivery vehicle of FIG. 3.

Referring now in addition to FIG. 4, further details are described of the parts of the submunition delivery vehicle 14. The submunitions 56 may be substantially identical to one another. Each of the submunitions 56 includes a submunition nose 60 and a submunition body 62. The submunition body 62 may have a tail cavity 64 for receiving the nose 60 of the submunitions 56 behind it. As described further below, each of the submunitions 56 may include deployable fins.

Five submunitions 56 are shown in the illustrated embodiment. However, it will be appreciated that the number of submunitions for a missile may be greater or less than that shown. Although the submunition delivery vehicle 14 is described generally herein as having multiple submunitions 56, more broadly the submunition delivery vehicle may have one or more submunitions 56, for example possibly having but a single submunition.

The tail section 50 may have a similar tail section nose 68 that fits into the tail cavity 64 of the last submunition 56. The aerodynamic control section 52 includes fins 70 and a ring 72 coupled to the fins 70. One or more of the fins 70 may have an antenna, transponder, or beacon 74.

It will be appreciated that the submunitions may be suitably mechanically coupled to one another, and may be coupled to the tail section 50, using any of a variety of suitable well-known couplers. Such coupling mechanisms may include use of any of a variety of well-known mechanical devices, such as clips and springs. Alternatively or in addition, adhesives may be utilized in the coupling. It will be appreciated that the coupling between various components of the submunition delivery vehicle 14 may include electrical connections that allow transmission of power and/or control signals from one part of the vehicle to another part.

FIG. 4 also shows further details of the tail section 50. Within the body of the tail section 50 is a controller or electronics 78. At the aft end of the tail section 50 is a tracer 80, for example, an infrared (IR) beacon. The antenna 74 and the tracer 80 may be used to send information to and/or receive information from a ground tracking station. The information may be used by the controller 78 in order to steer the submunition delivery vehicle 14. The antenna 74 and the tracer 80 may utilize different frequencies in communicating with the ground station. For example, the tracer 80 may be an IR beacon and the antenna 74 may rely on radio frequency (RF) communications. The antenna 74 may be a transponder, sending a signal in response to a signal received from the ground station or other source. Use of the antenna 74 and the tracer 80 allow the submunition delivery vehicle 14 to be easily tracked, enabling a tracking station to determine the position of the submunition delivery vehicle 14 relative to the position of a target. This allows course corrections to be made, and compensation to be made for movement of a target, allowing the submunition delivery vehicle 14 to more closely approach the target prior to release of the submunitions 56.

Figure 5:
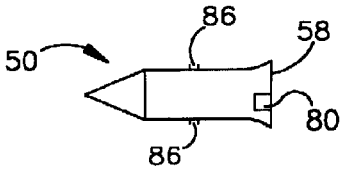
FIG. 5 is a side view showing an alternate embodiment tail section for the submunition delivery vehicle of FIG. 3.

It will be appreciated that the submunition delivery vehicle 14 may be steered by any of a number of methods. For example, the controller 78 may be configured to articulate the nose 60 of the forward-most submunition 56, thereby steering the submunition delivery vehicle 14. Alternatively, the tail section 50 may include diverter jets 86, as shown in FIG. 5, which selectively emit a pressurized gas to steer the submunition delivery vehicle 14. As a further alternative, the submunition delivery vehicle may have one or more moveable control surfaces, in order to effect steering of the submunition delivery vehicle 14.

Figure 6:
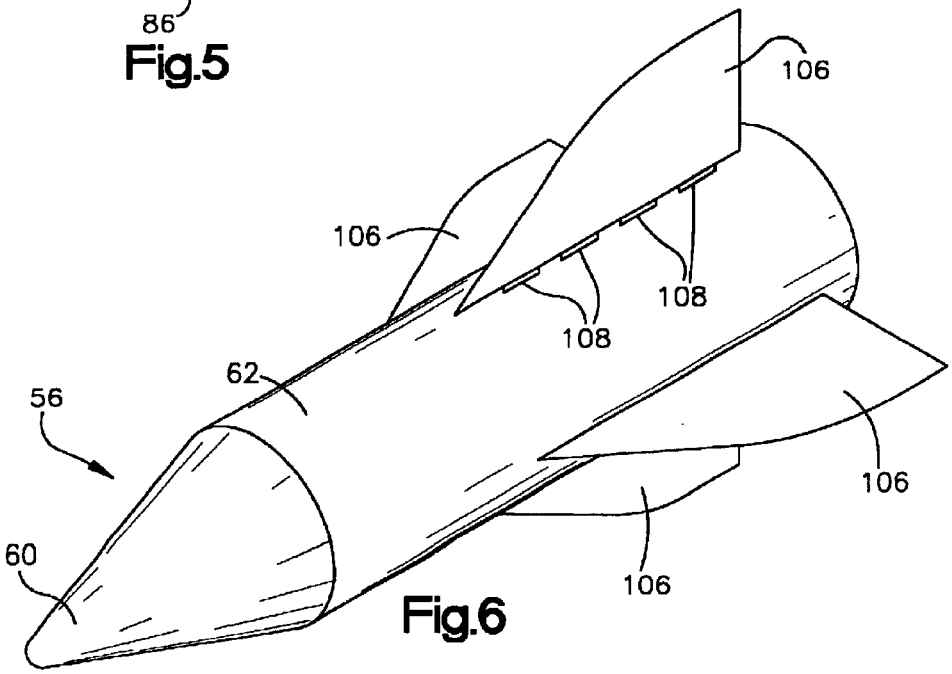
FIG. 6 is an isometric view of a submunition that is part of the missile of FIG. 1.
Figure 7:
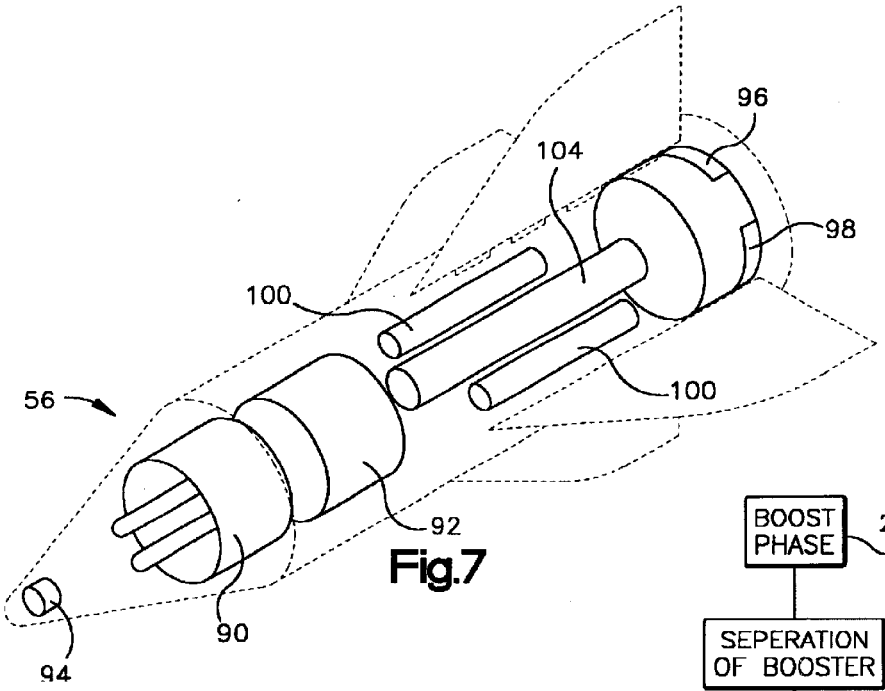
FIG. 7 is an isometric view showing interior details of the submunition of FIG. 6.

Turning now to FIGS. 6 and 7, details are shown of the submunitions 56. The nose 60 of the submunition 56 may be an articulatable, which may be shifted to steer the submunition vehicle 56 An actuator 90 may be used to tilt or otherwise move the nose 60 to a desired position to steer the submunition 56. The actuator 90 may be any of a wide variety of suitable, known devices for positioning the nose of a missile or projectile. Such devices may employ piezoelectric elements or any of a wide variety of mechanical devices. An example of a suitable device is the device shown in commonly-assigned U.S. Pat. No. 6,364,248, which is herein incorporated by reference in its entirety. The submunition 56 includes a motor and controller electronics 92 for controlling the actuator 90 and positioning the nose 60. The controller electronics may include well-known components, such as integrated circuits.

The submunition 56 also includes a submunition antenna 94 (FIG. 7), a receiver 96, a beacon or transponder 98, batteries 100 for powering various devices of the submunition 56, and a penetrator 104. The antenna 94 and/or the receiver 96 may be operatively coupled to the controller electronics 92 such that information about target location and/or desired course corrections may be sent to the submunition 56 from a remote location. Such information may be utilized by the controller electronics 92 in steering the submunition 56.

The penetrator 104 may be a heavy, dense rod designed to destroy or incapacitate the target. Suitable materials for the penetrator are tungsten and depleted uranium.

The submunition 56 also includes wrap-around fins 106, held to the body of the submunition 56 by hinges 108. The fins may conform to the body 62 of the submunition 56 when the missile 10 is launched. The fins 106 may be configured to be deployed outward after the booster 12 separates from the submunition delivery vehicle 14, either before or after the submunitions 56 separate from one another. The submunition fins 106 may be deployed centrifugally, by spinning the submunition delivery vehicle 14 or the individual submunitions 56. Alternatively, other suitable means may be used to deploy the fins 106. The hinges 108 may include locks to maintain the fins 106 in their deployed positions. The locks may include any of a variety of suitable mechanical elements.

If desired, the fins 106 may be canted relative to an axis of the submunition 56, so as to induce spinning in the submunition 56.

The actuator 90 may be any of a variety of suitable actuators including suitable hydraulic devices, hydroelectric devices, pyrotechnic devices, or mechanical devices, such as those described in U.S. Pat. No. 6,364,248. As is known, the nose 60 may be articulated in order to control the course of the submunition 56. For example, the nose 60 may be pointed in a direction of the target, which results in the submunition 56 correcting its course towards the target as well.

It will be appreciated that other devices may be alternatively or in addition used to control the course of the submunition 56. For example, moveable fins or divert thrusters may be employed.

After their separation from the submunition delivery vehicle 14, the individual submunitions 56 may be independently guided toward the target.

It will be appreciated that a wide variety of tracking devices and systems may be used to track the various parts of the missile 10, such as the booster 12, the submunition delivery vehicle 14, and the submunitions 56. Such devices include infrared (IR) beacons, radio frequency (RF) transceivers, transponders and/or transmitters, and heat created by the exhaust plume of the booster 12. An example of a system for tracking and guiding a hypersonic projectile is the system disclosed in commonly-assigned, co-pending application Ser. No. 09/795,577, filed Feb. 28, 2001 now U.S. Pat. No. 6,614,012, which is incorporated herein by reference. The system described therein utilizes a transceiver system mounted on a projectile. The transceiver system includes a low-power continuous-wave, millimeter wavelength wave emitter. A system at the launch platform communicates with the projectile. The platform system sends a blinking command to the projectile and measures the round trip delay thereof to ascertain the range of the projectile. Velocity is determined by conventional Doppler techniques or differentiation. Azimuth and elevation are then determined by a monopulse antenna on the launch platform. As a consequence, the platform ascertains the location of the projectile and the impact point thereof. The platform generates a command to the projectile that is received by the projectile and is used to actuate steering to adjust the trajectory and impact point as necessary.

It will be appreciated that the submunitions may each emit different identifying signals, so that they can be independently tracked. Further, it will be appreciated that signals sent to the submunitions 56 may be made suitably specific for controlling each of the submunitions 56 individually.

Figure 8:
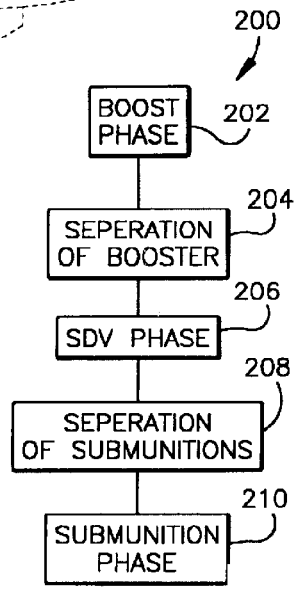
FIG. 8 is a high-level flowchart showing steps occurring during flight of the missile of FIG. 1.
Figure 9:
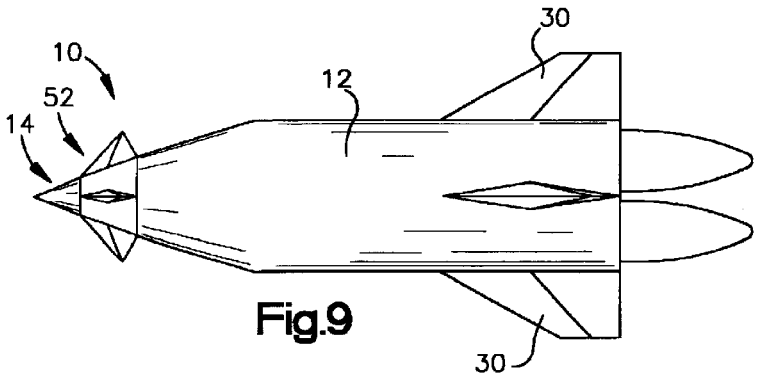
FIGS. 9–13 are side views illustrating the steps of the flowchart of FIG. 8.

Turning now to FIG. 8, high level steps of a method 200 are shown for guiding the missile 10 to a target. In step 202 of the method, illustrated in FIG. 9, a booster 12 is fired in a boost phase, which may quickly accelerate the missile 10 to hypersonic speeds. The booster 12 may be capable of rapidly accelerating the missile 10 to a hypersonic speed. As described above, the missile 10 may be guided during this phase by vectoring the thrust. Alternatively, the missile may be left unguided during this phase, as the phase may be of relatively short duration.

Figure 10:
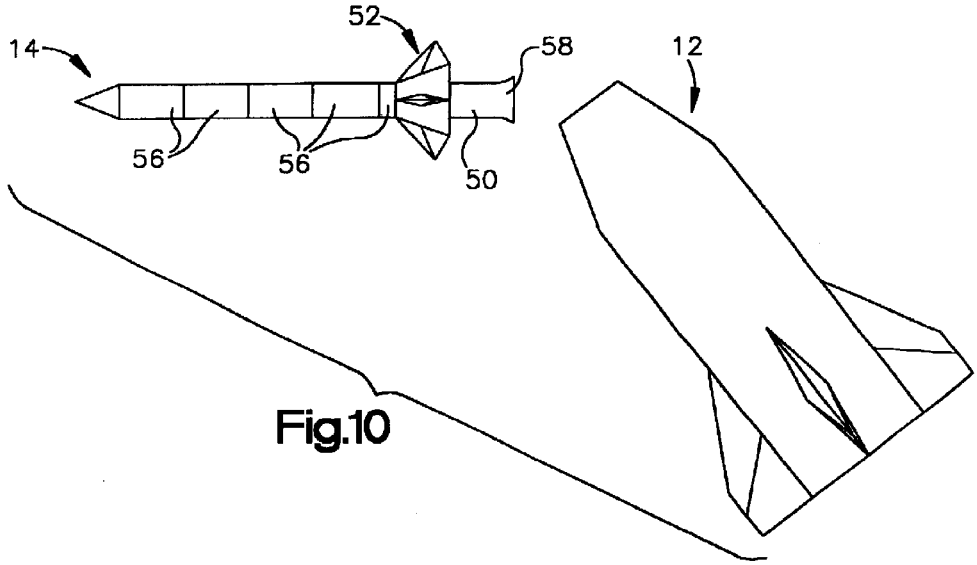
Figure 11:
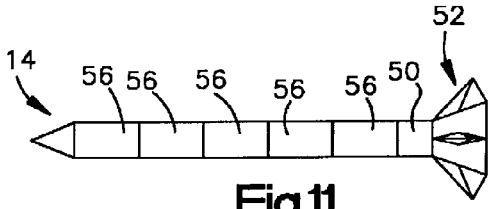
Figure 12:
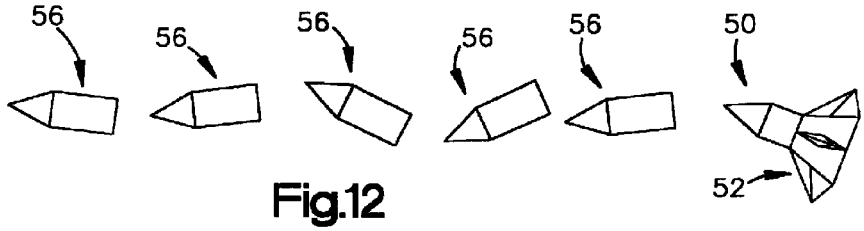
Figure 13:
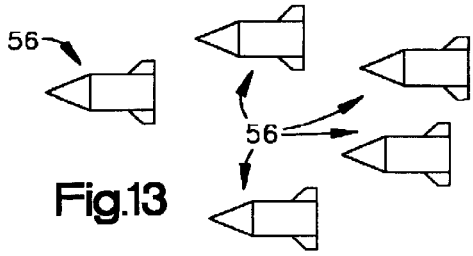

In step 204 of the method 200, illustrated in FIG. 10, the booster 12 bums out and is separated from the submunition delivery vehicle 14. After separation, the aerodynamic control section 52 slides to the back of the submunition delivery vehicle 14. During the submunition delivery vehicle (SDV) phase, in step 206, the submunition delivery vehicle 14 remains together and is guided into the vicinity of the target, as illustrated in FIG. 11. Thereafter, in step 208, the submunitions 56 are separated from one another and from the tail section 50, as shown in FIG. 12. This separation may be accomplished by any of a variety of suitable means, such as unlocking mechanical couplings holding the various parts of the submunition delivery vehicle 14 together. Alternatively, other devices such as small pyrotechnic charges may be utilized. Finally, in step 210, illustrated in FIG. 13, the submunitions 56 are individually guided toward the target.

The use of multiple submunitions 56 increases the chance of hitting the target, compared to prior missiles utilizing only a single munition device.

The missile 10 such as that described above, may be utilized in a wide variety of situations, for example, as surface-to-air missiles used to destroy or neutralize incoming missiles fired at a ship or a large structure.

A missile such as the missile 10 may also be utilized against other fast-moving targets, such as incoming attack boats. In addition, it will be appreciated that such missiles may be utilized against stationary targets.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A missile for hitting a moving target, the missile comprising:

a booster; and a submunition delivery vehicle separably coupled to the booster;

wherein the submunition delivery vehicle includes:

at least one submunition separable from the submunition delivery vehicle; and a beacon separably coupled to the at least one submunition; and wherein the beacon is configured to emit a signal indicating position of the submunition delivery vehicle.

2. The missile of claim 1, wherein the booster includes a thrust vectoring system.

3. The missile of claim 2, wherein the thrust vectoring system includes jet vanes.

4. The missile of claim 2, wherein the thrust vectoring system includes one or more thrust vectoring nozzles.

5. The missile of claim 1, wherein the submunition delivery vehicle includes an aerodynamic control section slidable along the submunition delivery vehicle; and wherein the aerodynamic control section includes multiple fins.

6. The missile of claim 1, wherein the at least one submunition includes multiple independently-maneuverable submunitions.

7. The missile of claim 6, wherein the submunitions are arrayed in line along an axis of the submunition delivery vehicle.

8. The missile of claim 7, wherein each of the submunitions includes a tail cavity capable of receiving a nose of another of the submunitions.

9. The missile of claim 6, wherein the submunitions each include an articulatable nose.

10. The missile of claim 9, wherein each of the submunitions further includes:

a nose actuator operatively coupled to the nose to position the nose; and controller electronics operatively coupled to the nose actuator to control steering of the submunition.

11. The missile of claim 10, wherein the controller electronics are operatively coupled to a receiver for receiving information from a remote location; and wherein the information is used in positioning the nose.

12. The missile of claim 6, wherein the submunitions are substantially identical with each other.

13. The missile of claim 6, wherein the submunitions each include deployable fins.

14. The missile of claim 1, wherein the beacon is included in a submunition delivery vehicle tail section that is part of the submunition delivery vehicle.

15. The missile of claim 14, wherein the tall section also includes:

an antenna for receiving control signals; and controller electronics coupled to the antenna.

16. The missile of claim 15, wherein the controller is operatively coupled to an articulatable nose of one of the at least one submunition, for steering the submunition delivery vehicle.

17. The missile of claim 1, wherein the missile is a surface-to-air missile used to neutralize an incoming missile.

18. A missile for hitting a moving target, the missile comprising:

a booster; and a submunition delivery vehicle separably coupled to the booster;

wherein the submunition delivery vehicle includes:

multiple independently-maneuverable submunitions; and a beacon coupled to the submunitions;

wherein the beacon is configured to emit a signal indicating position of the submunition delivery vehicle;

wherein the submunitions each include:

an articulatable nose;

a nose actuator operatively coupled to the nose to position the nose;

controller electronics operatively coupled to the nose actuator to control steering of the submunition;

a beacon configured to emit a signal indicating position of the submunition;

a tail cavity capable of receiving a nose of another of the submunitions; and deployable fins; and wherein the submunitions are arrayed in line along an axis of the submunition delivery vehicle.

19. The missile of claim 18, wherein the submunition delivery vehicle includes an aerodynamic control section slidable along the submunition delivery vehicle; and wherein the aerodynamic control section includes multiple fins.

20. A method of hitting a moving target using a missile, comprising:

accelerating the missile using a booster of the missile;

separating the booster from a submunition delivery vehicle of the missile, wherein the submunition delivery vehicle includes multiple independently-guidable submunitions;

separating the submunitions from the submunition delivery vehicle; and independently guiding the submunitions to the moving target;

wherein the independently guiding includes steering the submunitions by positioning respective articulatable noses of the submunitions.

* * * * *